US006071000A

United States Patent [19]

Rapp

[11] Patent Number: 6,071,000

[45] Date of Patent: Jun. 6, 2000

[54] VEHICLE LAMP WITH RAM AIR VENT

[75] Inventor: Robert A. Rapp, Columbus, Ind.

[73] Assignee: Valeo Sylvania, L.L.C., Seymour, Ind.

[21] Appl. No.: 09/161,333

[22] Filed: Sep. 25, 1998

[51] Int. Cl.[7] ..... F21V 29/00

[52] U.S. Cl. ..... 362/547; 362/546; 362/362; 362/363; 362/459; 362/507

[58] Field of Search ..... 362/547, 459, 362/487, 506, 507, 546, 362, 373

[56] References Cited

U.S. PATENT DOCUMENTS

| | | | |
|---|---|---|---|
| 4,809,144 | 2/1989 | Suzuki | 362/294 |
| 4,838,603 | 6/1989 | Masoero et al. | 296/180.1 |
| 4,937,710 | 6/1990 | Hurley et al. | 362/547 |
| 5,251,111 | 10/1993 | Nagengast et al. | 362/547 |
| 5,406,467 | 4/1995 | Hashemi | 362/294 |

*Primary Examiner*—Sandra O'Shea
*Assistant Examiner*—Ismael Negron
*Attorney, Agent, or Firm*—William E. Meyer

[57] ABSTRACT

A vehicle lamp with ram air vent having lamp housing, light source, ram air tube, and a second vent tube is disclosed. The vehicle lamp with ram air vent yields an air cooled lamp interior without acquiring excess water.

12 Claims, 4 Drawing Sheets

VEHICLE LAMP WITH RAM AIR VENT

TECHNICAL FIELD

The invention relates to electric lamps and particularly to vehicle lamps. More particularly the invention is concerned with vents for a vehicle lamp.

BACKGROUND ART

A common problem for exterior vehicle lighting is that supposedly sealed lamp housings may actually contain minute leaks (especially large multi-component lamp housing assemblies), such that the interior lamp housing volume does not remain constant. If there are small housing leaks, the air leaks out as its pressure increases due to the lamps heat. When the bulb is subsequently turned off, the internal air cools and the pressure drops. The resulting pressure difference between the inside and the outside draws in fresh air, including water into the lamp. If the lamp is particularly wet at the time, as in a rain storm, the amount of water drawn in can be substantial. This breathing cycle can then lead to the collection of liquid water inside the lamp housing.

The accumulated liquid water in the lamp interior is a primary failure mode of vehicle lamps. Interior water is visible to the customer, either as water sloshing around at the bottom of the lamp housing, or as severe fogging of the lamp lens. The interior water can contact the bulb's glass surface while the bulb is energized. The relatively cool water suddenly touching the hot glass (~900° F.) can cause the bulb to catastrophically shatter. Interior water can also degrade (oxidize) the thin metallized reflector surface, thus ruining the lamp's optical performance and cosmetic appearance. Additionally, standing water can corrode other lamp components or lead to the growth of green algae in lamp housing.

It is not clear that a plastic headlamp should be sealed, even if it could be sealed. If reliably sealed, the heating and cooling would still induce pressure changes causing the plastic walls to flex. Flexing the optical surfaces then influences the projected beam. The degree of change in the beam pattern would depend on various factors such as, ambient temperature and pressure, time of operation and so on. Since plastic headlamps are not reliably sealed, and likely should not be anyway, there is a need to properly vent the housing. Venting has its own problems.

While a vent should provide rapid pressure equilibration between the lamp housing's internal and external operating air pressures, it should not allow entry of liquid water or dirt into the lamp housing under normal operating environments.

A related problem with exterior vehicle lamp housings is that the lamp housing interior gets hot upon extended energization of the bulbs (capsules) in the confined interior lamp housing volume. The interior heating profile is typically not uniform, rather the interior lamp housing components directly above the capsules get hot (200–400° F.), whereas the components elsewhere in the lamp housing equilibrate at temperatures of 100–200° F. One of the factors causing the nonuniform interior temperature distribution is the lack of air flow in the lamp housing, and the lack of air interchange between the lamp housing internal and external environments.

There were four common methods used to solve the venting problem on exterior vehicle lamps: 1) the lamp housing was not vented at all (sealed), 2) a drain or labyrinth pathway was created in the lamp housing to allow free flow of air, yet provide a tortuous path to limit liquid water entry, 3) a rubber tube (normally opening downward) was attached over a lamp housing opening (boss) which also allowed air flow, yet provided a tortuous path for water entry, and 4) a hydrophobic membrane with pore sizes on the order of 0.5 to 5.0. was attached over a lamp housing opening, which allowed air to pass yet prevented the entry of liquid water. All of these vent types have been used on various vehicle lamp types including headlamps, fog lamps, signal lamps, combination lamps, and high mounted stop lamps.

With proper lamp housing and vent design, most of these vent types can be successful in preventing water intrusion into the lamp housing. Yet none of these vent types successfully alleviates the high local thermal loading of the interior lamp housing components directly above the energized capsules. The sealed lamp housing allows no air interchange between the internal and external lamp housing environments. The hydrophobic membranes allows only a miniscule amount of air interchange, but not nearly enough to cool interior hot-spots or change the interior air flow currents. While theoretically possible to allow air interchange, the drain and tube vent concepts do not significantly modify the internal convection currents due to the configuration of these vents and their location on the lamp housing. There is then a need for a vehicle lamp housing with an improved air vent.

DISCLOSURE OF THE INVENTION

An improved vented vehicle headlamp may be formed with a vehicle headlamp with a wall defining an enclosed volume. The wall is formed to include a first formed wall opening providing access to the enclosed volume. A light source positioned in the enclosed volume, and the headlamp is aligned to direct light from the light source in a forward direction. A ram air tube with a hollow tube with a first tube opening and a second tube opening, is positioned so that the first tube opening is coupled to the first formed wall opening, and the second tube opening is positioned to face in the forward direction to be exposed to direct airflow from the forward direction.

BEST MODE FOR CARRYING OUT THE INVENTION

Figure 1:
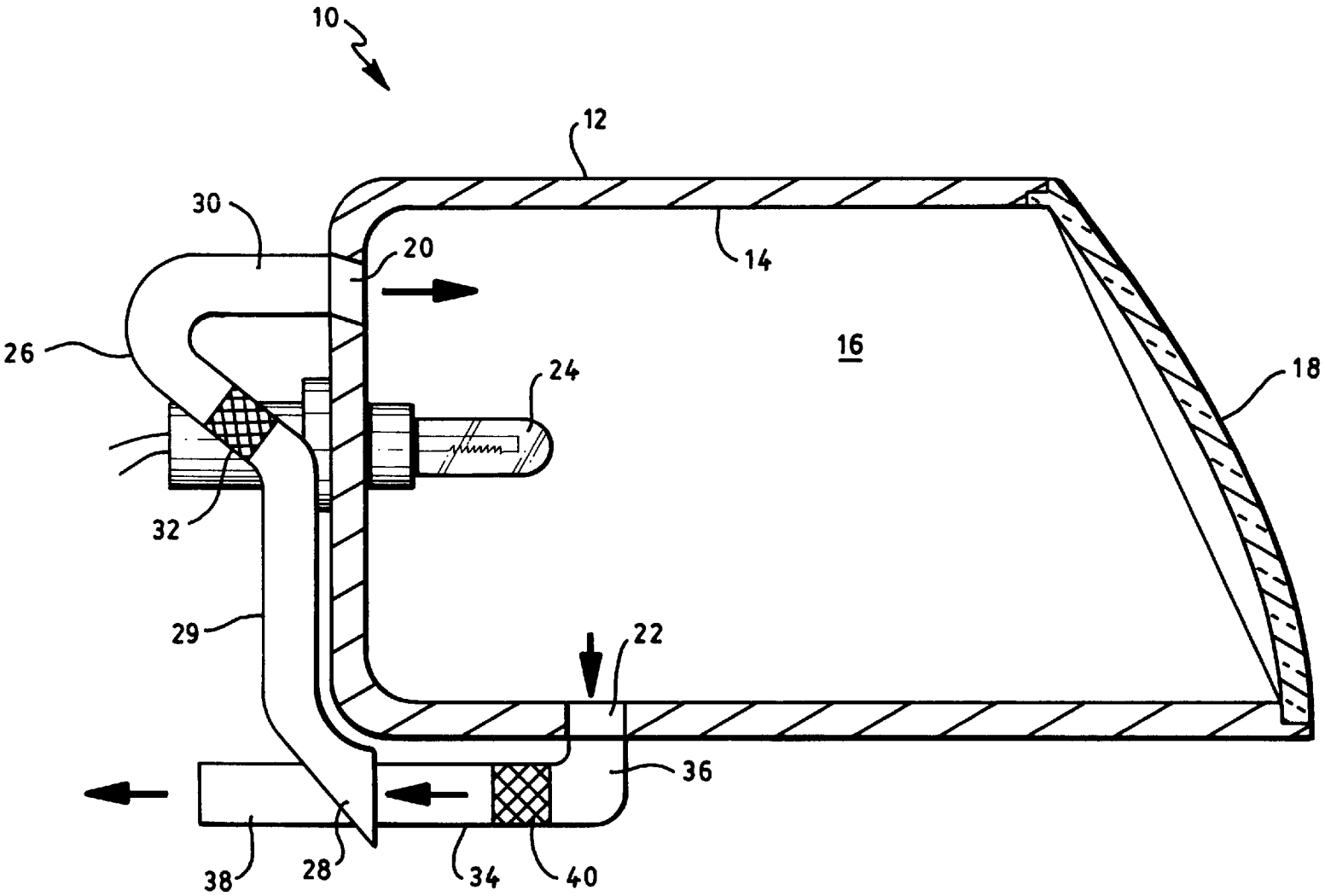
FIG. 1 shows a cross sectional view of a preferred embodiment of a vehicle lamp housing with ram air vent.

FIG. 1 shows a preferred embodiment of a vehicle lamp housing 12 with ram air tube 26. Like reference numbers designate like or corresponding parts throughout the drawings and specification. The vehicle lamp housing 12 with ram air tube 26 is assembled from a lamp housing 12, a light source 24, a ram air tube 26, and an optional second vent tube 34.

The lamp housing 12 may be made out of plastic resin or bulk fill compound to have the general form of a shell. The lamp housing 12 has a wall 14 defining an enclosed volume 16. The wall 14 is further formed with a first opening 20 from the exterior into the enclosed volume 16, and an optional second opening 22 from the enclosed volume 16 to the exterior. The preferred housing 12 includes features adapted to receive a light source 24, a lens 18, adjuster hardware, and other items as known in the art. Defined within the lamp housing 12 by the wall 14 is an enclosed volume 16. The enclosed volume 16 is sufficient to contain a light source 24, which may be an incandescent, tungsten halogen, HID or other lamp.

Positioned along lamp housing 12 is a first opening 20 from the exterior into the enclosed volume 16. The first opening 20 to the enclosed volume 16 may include a rim, tubular extension or otherwise may be similarly adapted to couple with a tube on the exterior side of the housing 12. The preferred positioning for the first opening 20 is in the rear upper half of the lamp housing, near but not directly over the light source 24. Water and other material should not be allowed to fall directly on the light source 24. On the other hand, cool air (arrow) flowing from the first opening 20 should induce air flow in the heated region directly above the light source 24. The second opening 22 is preferably located in the lower back half of the housing. It is particularly useful if the second opening 22 is located on the floor of the lamp housing 12 so as to act as a drain for any possibly collected water or other material.

The light source 24 may be an incandescent, tungsten halogen, HID or similar light source 24. In one embodiment the light source 24 had the general form of a tube supported by a holder with a flange and o-ring coupling. The light source 24 was coupled through a rear opening in the lamp housing 12 to expose the light source 24 in the enclosed volume 16, where the generated light was reflected from an reflective portions of the wall 14 and projected forward as a formed beam pattern. The lamp housing 12 encloses the light source 24.

The exterior of the first opening 20 is connected to a ram air vent tube 26 extending on the exterior of the lamp housing 12. The ram air tube 26 has a free end 28, and an attached end 30 coupled to the first opening 20. The free end 28 of the ram air tube 26 is positioned to face into the vehicle airstream (arrow) to force an air flow up the ram air tube 26 into the enclosed volume 16. The ram air tube 26 free end 28 is then oriented with respect to a forward direction of vehicle travel so as to scoop air as it normally blows by the headlamp housing 12 during normal vehicle travel. The ram vent tube 26 may include a tortuous path, and may include a water and dirt filter or block such as an open-celled foam insert 32 to encourage air flow in, and yet limit or prevent liquid water intrusion. In the preferred embodiment, the free end 28 is followed by an upward rising section 29 of the ram air tube 26 so that any entering water tends to be drained out of the tube by gravity. With vehicle motion, air enters the free end 28 to be forced up the ram air tube 26 and into the enclosed volume 16, providing a forced flow of cooler external air.

With its optimal mounting chosen to be near one of the lamp housing 12's internal hot-spots (near top-back of reflector), the forced air flow effectively circulates in the interior lamp housing 12 air, cooling local hot-spot conditions. By way of example ram air tube 26 is shown as a cylindrical, hollow rubber tube with a first open end facing directly into the oncoming air flow. The second end is sealed in attachment to the rear of the lamp housing 12 where a passage into the enclosed volume 16 is formed. Oncoming air may then flow through the ram air tube 26 into the enclosed volume 16.

Figure 2:
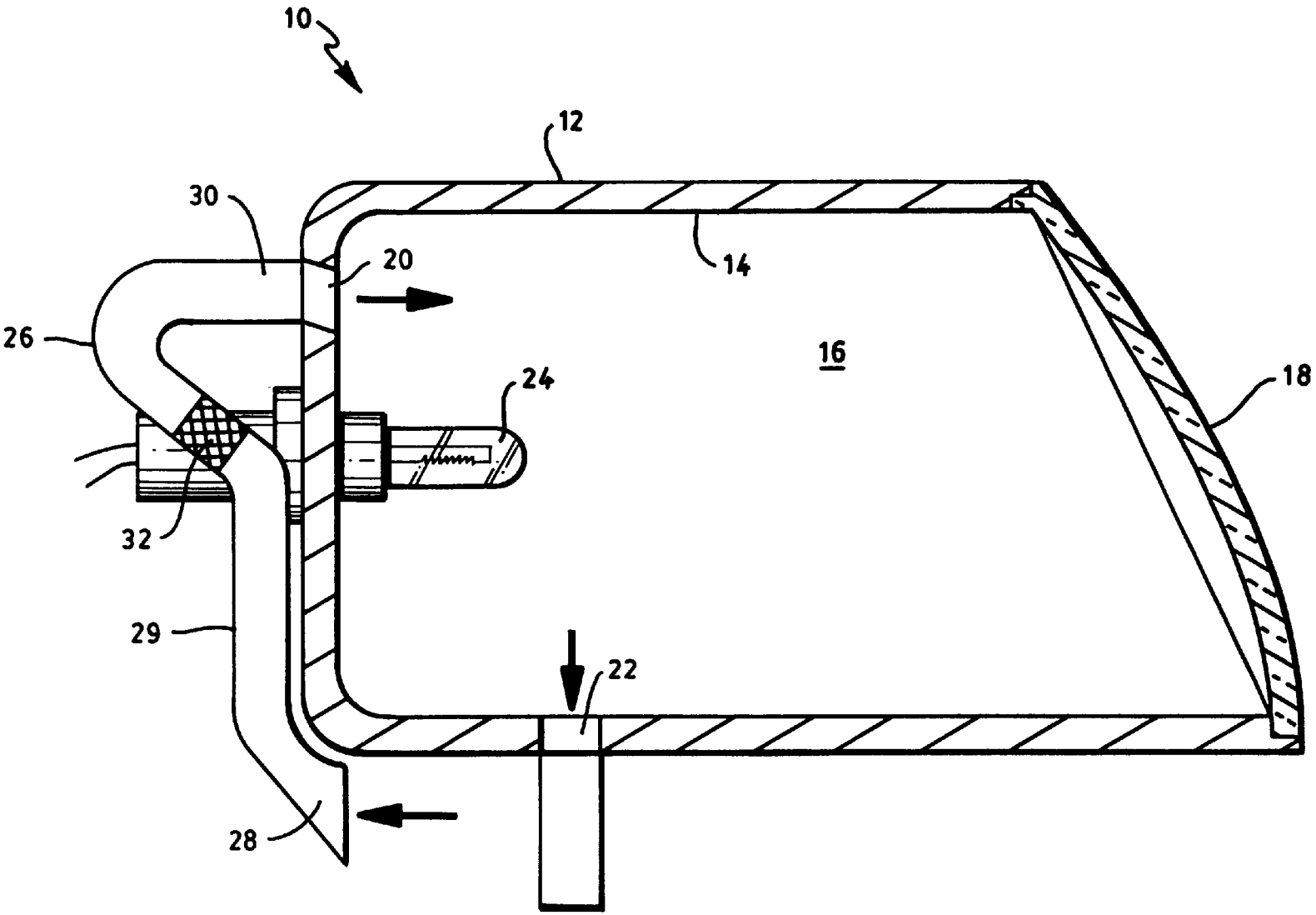
FIG. 2 shows an alternative schematic design of a lamp housing with the second vent tube positioned across, or transverse to the expected air flow.

A preferred variation is to include a second vent tube 34 with an attached end 36 and a free end 38. Again, the second vent tube 34 may include a tortuous path, and may include a water and dirt filter or block such as an open-celled foam insert 40 to encourage air flow out of the enclosed volume 16, and yet limit or prevent liquid water or dirt form entering. The second formed vent 22 is coupled to the attached end 36. The second vent tube's free end 38 is faced away from or across the airstream direction to minimize pressure (Bernoulli Principal), and thereby maximize air flow out of the second vent tube 34. The second tube opening is positioned with respect to the expected air flow from the forward direction to induce a low pressure zone in the region of the second tube opening to thereby induce air flow from the enclosed volume 16 to the exterior. A lower pressure in the second tube may be achieved by facing the second end transverse to the air flow direction, or facing the downstream airflow direction to thereby induce suction in the second vent tube 34 from the exterior. FIG. 2 shows a schematic design of a lamp housing with the second vent tube 42 positioned across, or transverse to the expected air flow. The free end 38 of the second vent tube 34 is positioned to induce the maximal air flow out of the second vent tube 34. In combination maximizing the air flow into the ram air tube 26 and out of the second vent tube 34 provides the maximal air flow through the enclosed volume 16.

Figure 3:
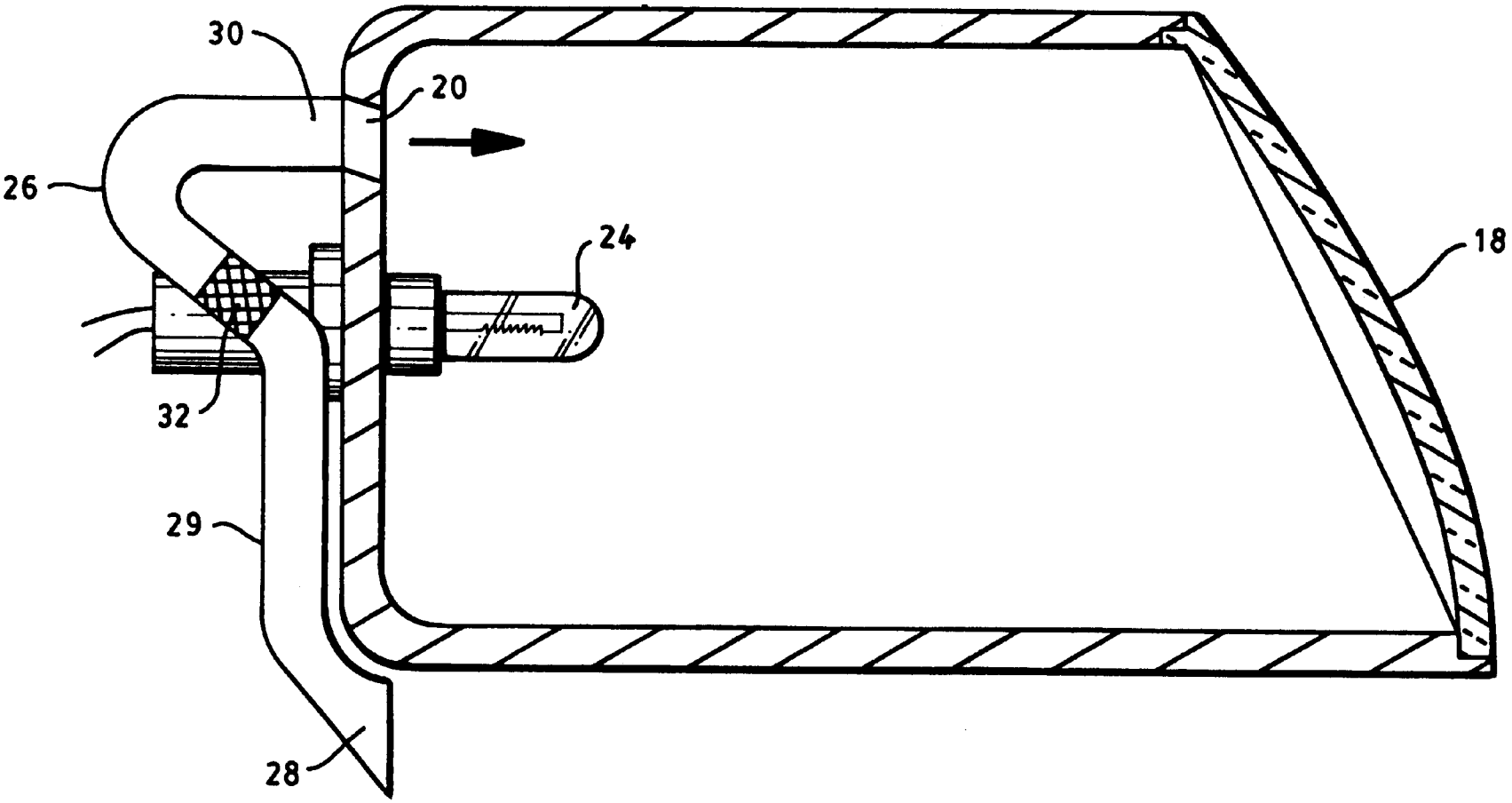
FIG. 3 shows an alternative schematic design of a lamp housing with a single ram air vent tube.

FIG. 3 shows a schematic design of a lamp housing with a single ram air vent 44. The two vent system is preferred. However, a single ram air vent system is useful. With changing air pressures, and temperatures, a ram air vent system can work with only one ram air vent 44.

Figure 4:
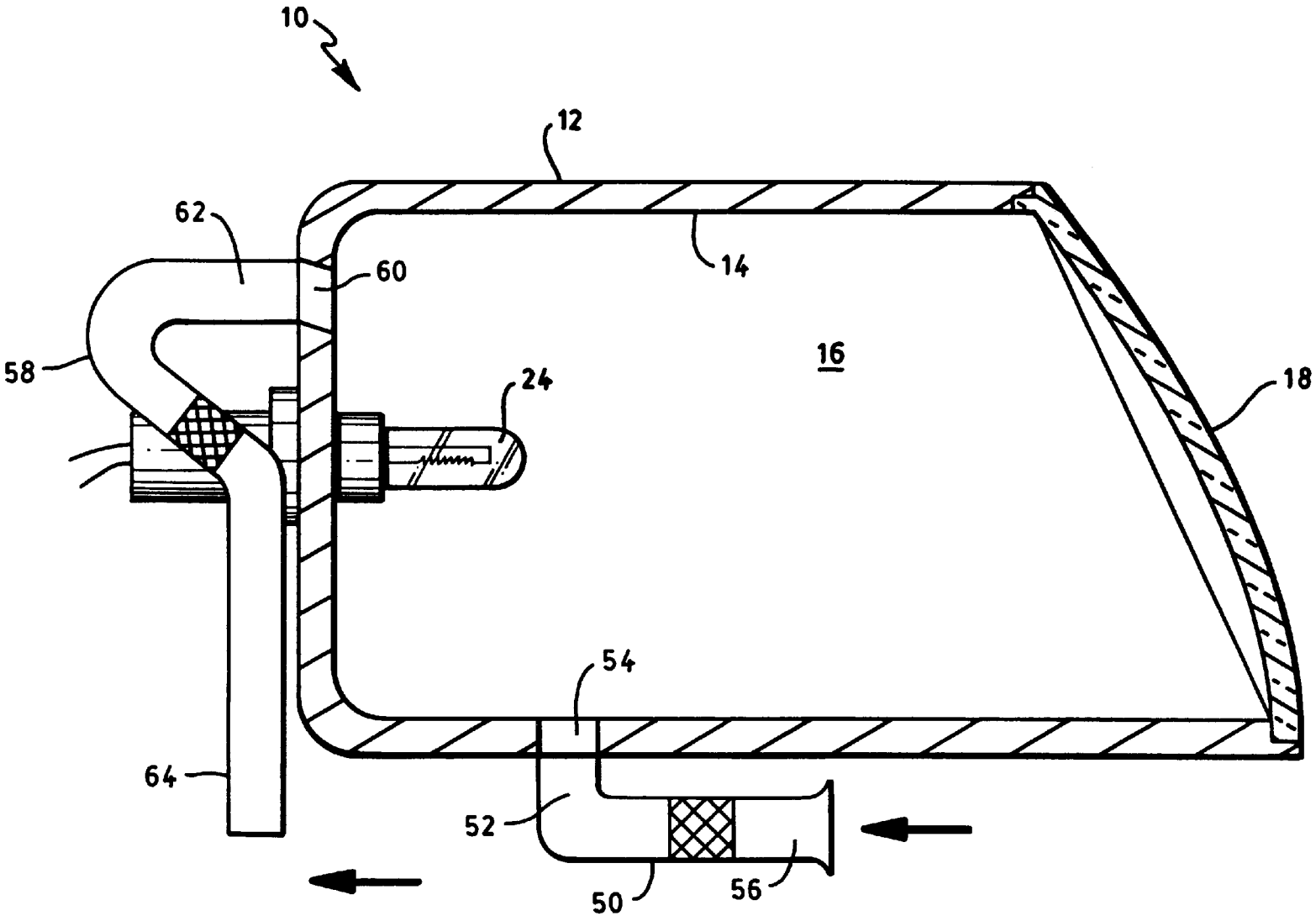
FIG. 4 shows an alternative schematic design of a lamp housing with the ram air tube and the second vent tubes reversed.

FIG. 4 shows an alternative schematic design of a lamp housing with a ram air tube and the second vent tubes reversed. The ram air tube 50 may be coupled at a first end 52 to a first vent 54 at the lowest region of the enclosed volume 16, while the free end 56 faces the air stream. The second vent tube 58 couple at attached end 62 to the second vent 60 located adjacent a hot region above the light source 24. The free end 64 may be positioned to open transverse to the air stream. The filters, slopes and convolutions may be similar. Fresh air is then rammed in from below, while hot air is sucked from the top, hot region. If water is drawn in, it may later drain through the ram air tube.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A vented vehicle lamp comprising:

a vehicle lamp housing with a wall defining an enclosed volume, the wall including a first formed opening providing access to the enclosed volume, a light source positioned in the enclosed volume, the lamp being aligned to direct light from the light source in a forward direction, a ram air first vent tube comprising a hollow tube with a first tube opening and a second tube opening, the first tube opening being coupled to the first formed wall opening, and the second tube opening positioned to face in the forward direction, and exposed to direct airflow from the forward direction.

2. The vehicle lamp in claim 1, wherein the second tube opening of the ram air first vent tube is positioned to have maximal air pressure during forward motion of the lamp.

3. The vehicle lamp in claim 1, wherein the second tube opening of the ram air first vent tube is positioned at a right angle to the airflow for maximal airflow into the ram air first vent tube.

4. The vehicle lamp in claim 1, wherein the second tube opening is positioned at a lower height from the ground than the next adjacent section of the ram air first vent tube so that gravity will drain water from the next adjacent section of the ram air first vent tube.

5. The vehicle lamp in claim 1, wherein the ram air first vent tube includes a filter body positioned in the ram air first vent tube.

6. A vented vehicle lamp comprising:

a vehicle lamp housing with a wall defining an enclosed volume, the wall including a first formed opening providing access to the enclosed volume, a light source positioned in the enclosed volume, the lamp being aligned to direct light from the light source in a forward direction, a ram air first vent tube comprising a hollow tube with a first tube opening and a second tube opening, the first tube opening being coupled to the first formed wall opening, and the second tube opening positioned to face in the forward direction, and exposed to direct airflow from the forward direction;

wherein the wall further includes a second formed opening, and the lamp further includes a second vent tube comprising a hollow tube with a first tube opening and a second tube opening, the first tube opening being coupled to the second formed wall opening, and the second tube opening positioned to not face in the forward direction.

7. The vehicle lamp in claim 6, wherein the second formed opening is located in a lowest section of the enclosed volume.

8. The vehicle lamp in claim 6, wherein the second tube opening of the second vent tube is positioned to parallel to the airflow for maximal airflow out from the second vent tube.

9. The vehicle lamp in claim 6, wherein the second tube opening of the second vent tube is positioned to have minimal air pressure during forward motion of the lamp.

10. The vehicle lamp in claim 6, wherein the ram air first vent tube is coupled to a lowest region of the enclosed volume, and the second vent tube is coupled adjacent a hot region of the enclosed volume.

11. A vented vehicle lamp comprising:

a vehicle lamp housing with a wall defining an enclosed volume, the wall including a first formed opening providing access to the enclosed volume, a light source positioned in the enclosed volume, the lamp being aligned to direct light from the light source in a forward direction, a ram air first vent tube comprising a hollow tube with a first tube opening and a second tube opening, the first tube opening being coupled to the first formed wall opening, and the second tube opening positioned to face in the forward direction, and exposed to direct airflow from the forward direction;

wherein the first formed opening is located adjacent a region directly above the light source.

12. A vented vehicle lamp comprising:

a vehicle lamp housing with a wall defining an enclosed volume, the wall including a first formed opening providing access to the enclosed volume, and the wall including a second formed opening providing access to the enclosed volume, a light source positioned in the enclosed volume, the lamp being aligned to direct light from the light source in a forward direction, a ram air first vent tube comprising a hollow tube with a first tube opening and a second tube opening, the first tube opening being coupled to the first formed wall opening, and the second tube opening positioned to face in direction of maximal air flow thereby providing the maximal air pressure during forward motion of the lamp;

the ram air first vent tube including a first filter body positioned in the ram air first vent tube;

the second tube opening of the ram air first vent tube being positioned at a lower height from the ground than the next adjacent section of the ram air first vent tube, so that gravity will drain water from the next adjacent section of the ram air first vent tube;

the wall further including a second formed opening providing access to the enclosed volume, and the lamp further including a second vent tube comprising a hollow tube with a first tube opening and a second tube opening, the first tube opening being coupled to the second formed wall opening, and the second tube opening of the second vent tube positioned to face in direction providing the minimal air pressure during forward motion of the lamp; and the second vent tube including a second filter body positioned in the second vent tube.

* * * * *